United States Patent [19]

Ancheta

[11] Patent Number: 4,576,126

[45] Date of Patent: Mar. 18, 1986

[54] TWO-STROKE INTERNAL COMBUSTION ENGINE

[76] Inventor: Antonio D. Ancheta, 446 Toronto St., Winnipeg, Manitoba, Canada, R3G 1S5

[21] Appl. No.: 590,416

[22] Filed: Mar. 16, 1984

Related U.S. Application Data

[63] Continuation-in-part of Ser. No. 418,277, Sep. 15, 1982, abandoned, which is a continuation-in-part of Ser. No. 197,003, Oct. 14, 1980, abandoned, which is a continuation-in-part of Ser. No. 59,687, Jul. 23, 1979, abandoned.

[51] Int. Cl.[4] ..... F01P 1/04

[52] U.S. Cl. ..... 123/41.38; 123/65 BA; 123/193 P; 123/196 R; 92/186

[58] Field of Search ..... 123/65 B, 65 BA, 65 P, 123/196 R, 193 P, 41.35, 41.38, 41.39; 210/DIG. 17; 277/177; 92/186, 258, 230, DIG. 2

[56] References Cited

U.S. PATENT DOCUMENTS

| | | | |
|---|---|---|---|
| 2,111,282 | 3/1938 | Edwards | 123/65 BA |
| 2,858,666 | 11/1958 | Fullemann | 123/65 BA |
| 3,057,436 | 10/1962 | Jacobson et al. | 123/196 R |
| 3,555,972 | 1/1971 | Hulsing | 123/193 P |
| 3,975,273 | 8/1976 | Shaltz et al. | 210/DIG. 17 |
| 4,028,892 | 6/1977 | Hinkle | 123/65 BA |
| 4,092,967 | 6/1978 | Haslett | 123/193 P |

FOREIGN PATENT DOCUMENTS

| | | | |
|---|---|---|---|
| 1121406 | 1/1962 | Fed. Rep. of Germany | 123/65 BA |
| 605610 | 7/1948 | United Kingdom | 123/65 BA |

*Primary Examiner*—Magdalen Y. C. Moy
*Assistant Examiner*—David A. Okonsky
*Attorney, Agent, or Firm*—Stanley G. Ade

[57] ABSTRACT

A two-stroke diesel or gas fueled multi-cylinder engine utilizes a re-circulating type constant pressure feed lubrication system and is equipped with a supercharger or turbocharger combination connected in series to assist in charging the cylinders with air and also assists in scavenging the exhaust gases. The piston head is domed to assist the flow of the scavenging air in an upward direction toward the inside of the cylinder, and to facilitate the flow of exhaust gases to atmosphere. The scavenging port and exhaust port openings are formed in the same plane through the walls of the cylinder above the bottom dead center position of the piston head. The lower side of the scavenging port opening inclines inwardly and upwardly toward the cylinder wall so that the flow of scavenging air creates a turbulent action as it enters inside the cylinder for efficient scavenging of the exhaust gases. The scavenging port and exhaust port openings are both uncovered and covered simultaneously by the reciprocating piston passing thereby. A sealing "O" ring is installed into an annular groove formed in each boss of the piston adjacent the end portions of the wristpin to prevent the escape of lubricating oil and it should also be noted that the oil scraper ring which is installed in an annular groove around the bottom edge portion of the piston skirt with drain holes extending through the groove remains below the exhaust port and scavenging port openings at all times to prevent lubricating oil from escaping therethrough.

9 Claims, 9 Drawing Figures

TWO-STROKE INTERNAL COMBUSTION ENGINE

BACKGROUND OF THE INVENTION

This invention is a Continuation-IN-Part application of Ser. No. 418,277 filed Sept. 15, 1982, now abandoned, which is a Continuation-In-Part application of Ser. No. 197,003 filed Oct. 14, 1980, now abandoned which is a Continuation-In-Part application of Ser. No. 059,687 filed July 23, 1979 and now abandoned.

This invention relates to a new and improved construction and method of operating a super-turbocharged two-cycle multi-cylinder diesel or gas fueled internal combustion engine that can be manufactured as an inline or V-type configuration. Of importance is the piston assembly having a novel feature of design that overcomes the principal problems and difficulties of equipping a two-cycle multi-cylinder super-turbocharged diesel or gas engine with a re-circulating type constant pressure feed lubrication system to lubricate all the vital and critical moving parts at all times.

This invention is also equipped with a supercharger or turbocharger combination connected in series to provide excellent power and acceleration capabilities. Another unique design feature of this invention is that gas engine fuel injection is used in which the design of the fuel spray nozzle or fuel injector assembly includes a cone-shape needle valve that opens under low pressure to inject metered atomized gaseous fuel at a precise time in relation to the position of the piston heat at the scavenging port opening. The location and design of the scavenging port and exhaust port openings of each cylinder permits same to be uncovered and covered simultaneously by the reciprocating piston passing thereby and thus provides the excellent operation of this machine.

SUMMARY OF THE INVENTION

Among the objects of this invention is to eliminate the disadvantages, limitations, difficulties and inefficient operation of two-cycle engines of this type especially if a re-circulating type constant pressure feed lubrication system is used.

Another object of this invention is to disclose and provide a device of the character herewithin described which includes a new and improved design of the piston assembly for both gas and diesel fueled engines, having novel feature of design that eliminates and controls lubrication consumption problems especially if a re-circulating type constant pressure of lubrication system is used.

Still another object of this invention is to disclose and provide a device of the character herewithin described in which gas engine fuel injection equipment is used having a fuel spray nozzle or fuel injector assembly with a cone-shape needle valve that opens under low fuel pressure to inject metered atomized gas fuel into each cylinder with a precise timing in relation to the position of the piston head at the scavenging port openings.

Still another object of this invention is to provide a supercharger or turbocharger combination in a two-stroke multi-cylinder diesel or gas fueled internal combustion engine of this type and to utilize a re-circulating type constant pressure feed lubrication system for lubricating all the vital and critical moving parts.

Still another object of this invention is to disclose a supercharger or turbocharger combination connected in series to provide excellent power and acceleration capabilities.

Still another object of this invention is to provide a device which can be manufactured as a single or as a multi-cylinder inline or V-type gas or diesel engine with a comapct design, having less internal moving parts and less weight than is conventional, which provides a unique powerplant for cars, trucks and a variety of unlimited applications.

In accordance with the invention there is provided a two-stroke multi-cylinder, super-turbocharged diesel or gas fueled internal combustion engine, with inline or V-type configuration utilizing a re-circulating type constant pressure feed lubrication system, comprising in combination a cylinder block having cylinder bores formed therein, a cylinder head having precombustion chamber installed therein (for diesel engines) for each cylindrical bore, said cylinder head being bolted to the upper end of the cylindrical bores to close same, a piston assembly in each of said bores including a piston having a domed head design and a connecting rod operatively connected to said piston for reciprocating same between top dead center and bottom dead center, a crankshaft mounted for rotation at the base of said block which is bearingly supported, which are lubricated with a constant pressure feed type of lubrication, a re-circulating type of constant pressure oil pump mounted at the base of the block and being operatively connected to the crankshaft by means of gears, an oil pan enclosing the lower end of the cylinder block together with the crankshaft and oil pump assembly, said cylindrical bores having scavenging port and exhaust port openings formed in axial position and in the same plane through the walls of the cylinder above the bottom dead center position of the piston head, said ports being both uncovered and covered simultaneously by the reciprocating piston passing thereby.

For efficient scavenging of the exhaust gases, the design of the lower side of the scavenging port opening is inclining inwardly and upwardly toward the walls of the cylinder so that when the scavenging port is fully uncovered by the domed head of the piston, the flow of the scavenging air as it enters inside the cylinder creates a swirling turbulent motion in an upward direction to completely scavenge the burnt gases.

The duration of the opening period of both the scavenging port and exhaust port for both gas and diesel engine is approximately 130° to 135° of crankshaft rotation. In a gas engine the direction of injection period for injecting the fuel is approximately 10° to 15° of crankshaft rotation, with the injection of the gas fuel beginning approximately 10° before the head of the piston covers the scavenging port opening.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
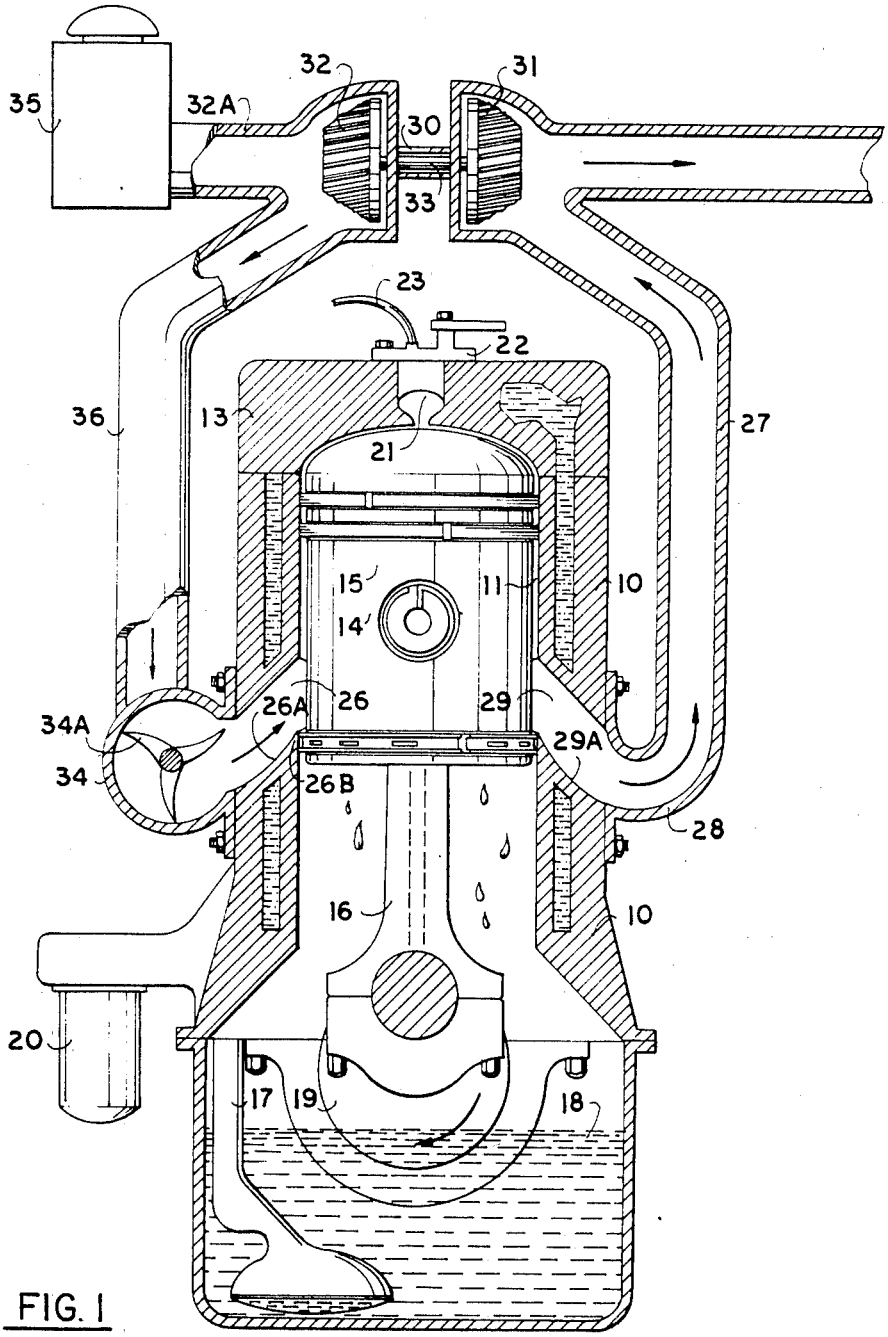
FIG. 1 is a general schematic sectional side view of a single cylinder two-stroke diesel engine equipped with super-turbocharger combination connected in series and utilizing a re-circulating type constant pressure lubrication system. This view clearly shows the internal moving parts in general and the position of the piston at the top dead center of its stroke.
Figure 2:
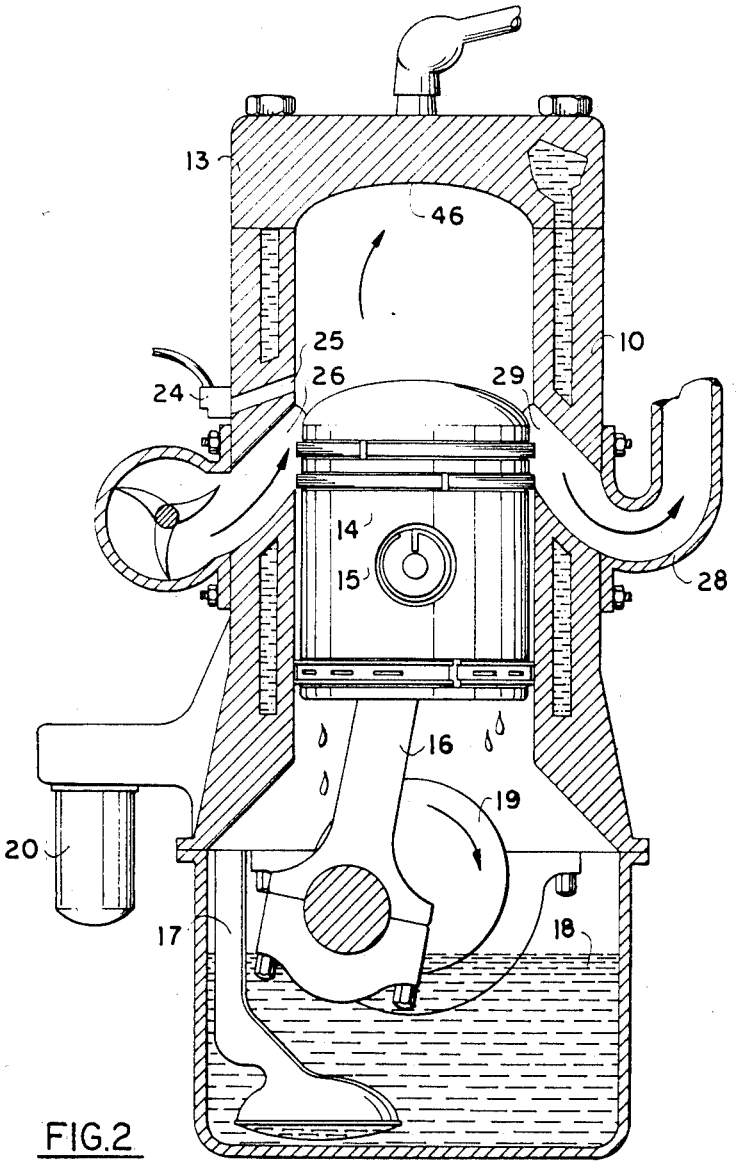
FIG. 2 is a schematic sectional side view of a single cylinder two-stroke gas engine utilizing fuel injection type fuel system and equipped with recirculating type constant pressure lubrication system and also equipped with supercharger. It clearly shows the location of the fuel spray nozzle or fuel injector and the approximate position of the piston head at the scavenging port opening when the spray of fuel begins.
Figure 3:
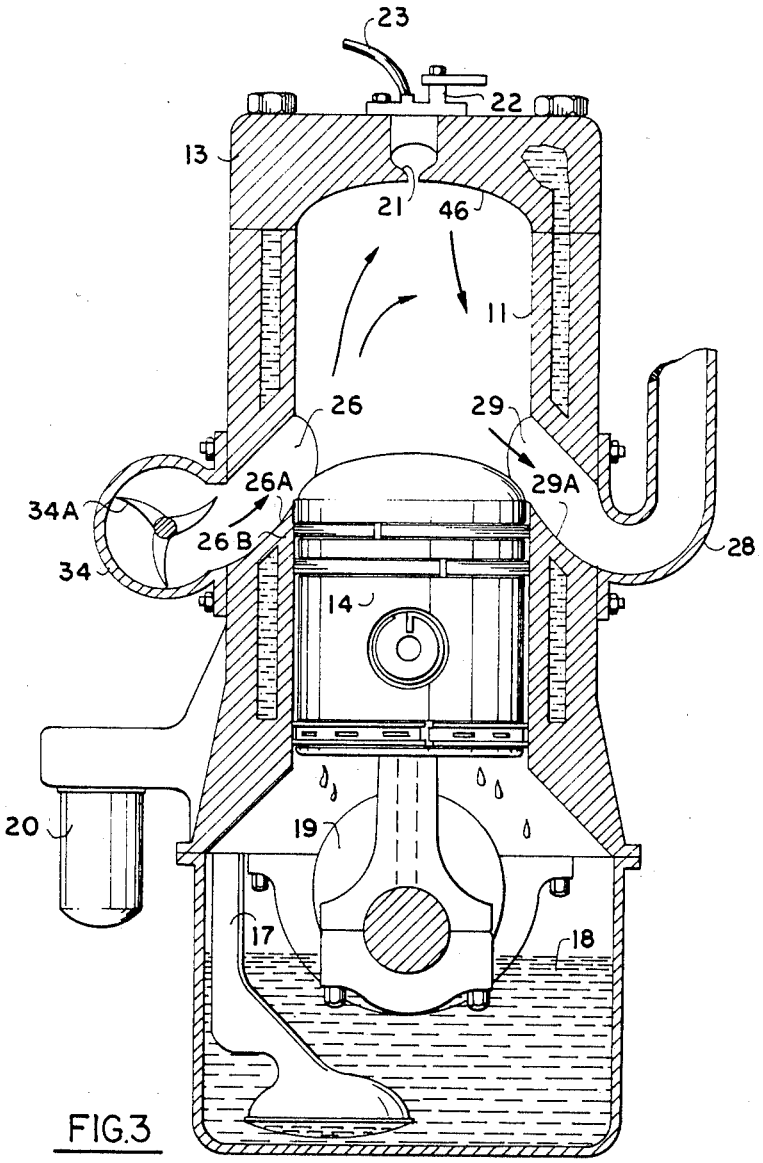
FIG. 3 is a view showing the piston position at the bottom dead center of its stroke. It clearly shows the position of the domed head of the piston in relation to both the scavenging port and exhaust port openings when these are fully uncovered and a blast of super-atmospheric pressure air under swirling turbulent motion enters the cylinder in an upward direction as it is being deflected by the dome of the piston head.

Proceeding therefore to describe the invention in detail, reference should first be made to FIGS. 1 to 3 in which reference character 10 illustrates generally a cylinder block including a cylinder bore 11, water cooling passages 12 formed therein and a cylinder head 13 having pre-combustion 21, injector 22 and glow plug 23 both installed securely to said pre-combustion chamber. The cylinder head 13 is secured to the upper side of the cylindrical bores by conventional means (not illustrated).

A piston assembly is reciprocal within said cylinder, said piston assembly being generally designated by reference character 14 and including a piston collectively designated 15 and a connecting rod collectively designated 16, details of which will hereinafter be described.

A constant pressure lubricating oil pump 17 which is submerged within an adequate amount of lubricating oil 18, is operatively driven by the crankshaft 19 by means of gears (not illustrated).

The crankshaft 19 is supported with several conventional bearings and is lubricated with filtered lubricating oil under constant pressure at all times. The spin-on oil filter 20 filters all the lubricating oil before it is supplied to all vital moving parts.

In the diesel engine illustrated in FIGS. 1 and 3, a pre-combustion chamber 21 is installed into a machined opening formed in the cylinder main combustion chamber of each cylinder. A fuel injector assembly 22 and glow plug 23 are operatively installed in the pre-combustion chamber by conventional means, details of which will hereinafter be described.

In the gas engine shown in FIG. 2, a fuel spray nozzle or fuel injector assembly 24 is bolted or screwed into an opening 25 formed in the cylinder close to the upper side of the scavenging port opening 26 of each cylinder, details of which will hereinafter be described.

A streamlined exhaust gas conduit 27 leads to an exhaust manifold 28 which is bolted to the cylinder block 10 at the exhaust port opening 29, said exhaust conduit is connected to the turbocharger 30 having a turbine wheel 31 which is mechanically connected to the air compressor wheel 32 by the shaft 33 supported with two oil bathed bearings in a conventional manner (not illustrated).

A supercharger assembly collectively designated 34 (FIGS. 1 to 4) having a scoop type compressor wheel 34A is operatively connected to the engine and driven by V-belt pulleys or by gears (not illustrated) to supply air under super-atmospheric pressure to the scavenging port 26 which may be connected to an air manifold if a plurality of piston and cylinders are utilized. The scavenging port 26 in the lower side portion 26A inclines inwardly and curves upwardly toward the wall of the cylinder, the purpose of which is so that the scavenging air, as it enters the cylinder, creates a turbulent motion as it swirls in an upward direction and efficiently scavenges the exhaust gases remaining inside the cylinder.

A dry type air filter 35 is connected to the air compressor wheel casing 32A of the turbocharger 30 and is provided with air manifold 36 connected to the supercharger, so that filtered air is supplied to scavenge the individual cylinders.

It will also be appreciated that supercharger 34 can be used with all configurations or alternatively, a turbocharger 30 and supercharger 34 combination connected in series may be utilized as shown schematically in FIGS. 1 to 4 collectively and designated 30 and 34.

Figure 4:
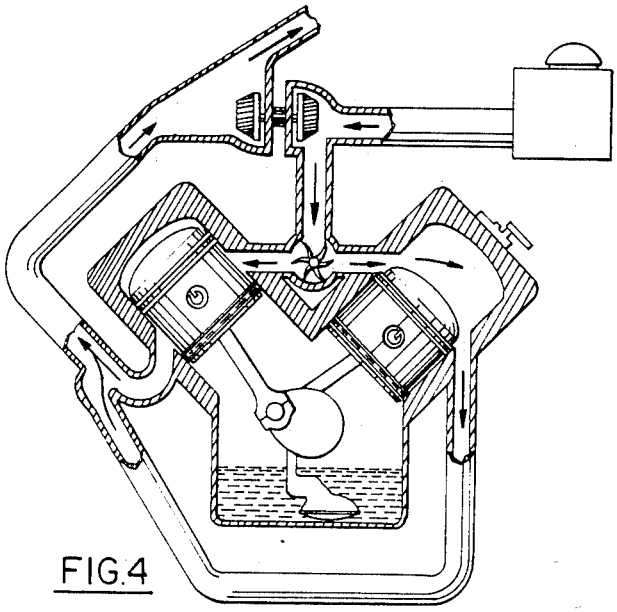
FIG. 4 is a view showing the schematic sectional side view of a V-type two-stroke multi-cylinder engine, utilizing pressure feed lubrication and equipped with supercharger or turbocharger combination connected in series.

As mentioned previously, this invention is suitable for use with multi-cylinder inline or V-type configurations as shown schematically in FIG. 4.

Figure 5:
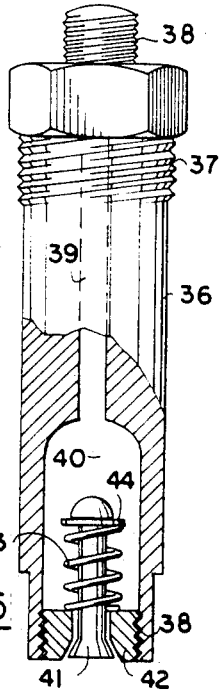
FIG. 5 is a fragmentary cross sectional view of a gas fuel spray nozzle or fuel injector assembly as used in a gas engine.

Reference should be made to the spray nozzle or fuel injector assembly 24 designed for use in gas engines equipped with fuel injection types of fuel systems, as illustrated in detail in FIG. 5.

The injector body 36 has a calibrated fuel passage 39 with the spray nozzle tip 38 having cone-shaped needle valve 41 with its matched seat and details of construction are included later on in the specification.

Said fuel spray nozzle assembly injects metered atomized fuel low pressure, supplied by the fuel injection system in a conventional manner (not illustrated). The cone-shape design of the needle valve 41 is such that the expansion pressure of the burnt gases cannot escape or back-up into the fuel system through the nozzle assembly.

Figure 6A:
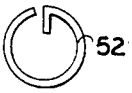
FIGS. 6 and 6A are fragmentary cross sectional views of the connecting rod and piston assembly design as used in both gas or diesel engines.
Figure 6:
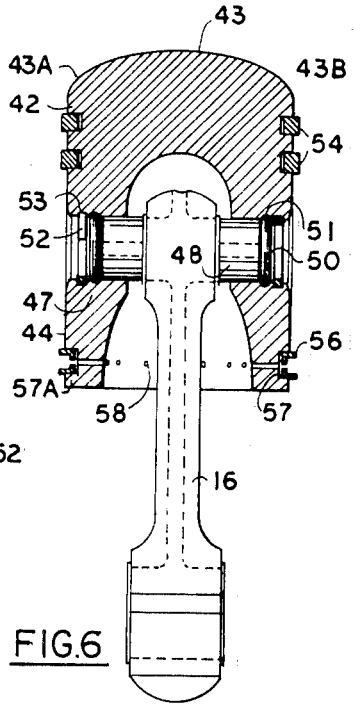

Details of the preferred embodiment of the piston assembly is illustrated in FIG. 6. The piston is preferably formed from aluminum alloy and includes a piston head 42, a piston head crown 43 and a surrounding cylindrical skirt portion 44.

The piston crown 43 is convexedly domed as illustrated by reference character 42 and convexedly curved on both sides 43A and 43B towards the scavenging port 26 and exhaust port 29.

This design of the dome of the piston head facilitates the flow of the scavenging air in an upward direction as it enters the cylinder thus creating a turbulent motion and providing efficient scavenging of the burnt gases. At the same time, the flow of the exhaust gases at the exhaust port, eject freely towards the exhaust manifold 28.

A pair of opposed p;iston bosses 47 are formed within the wall of the piston in a conventional manner and a wristpin 48 bearingly engages said bosses and also bearingly engages the wristpin end 49 of the connecting rod 16.

It is desirable to seal the outer end portions of the wristpin 48 to prevent the splash of the lubricating oil underside the piston head from being discharged through the bosses 47 supporting the wristpin. An "O" ring type of seal 50, made of material having a high temperature resistance property is installed in an annular groove 51 formed close to the outer edge portion of each of the bosses of the piston.

For safety of operation and to prevent cylinder wall wear, it is desirable to keep the wristpin in its center position at all times so that a pair of retainer rings or keepers 52 is installed, one each in an annular groove formed close to the outermost edge portion of each of the piston bosses 47 adjacent the annular groove for the sealing ring. The magnified view of the design of the retainer ring 52 is shown as 52 in FIG. 6A.

Two or more compression piston rings 54 are seated within the piston ring grooves 55 around the piston adjacent the upper end of the head thereof and an oil scraper ring 56 is installed within an annular groove 57 adjacent the base of the skirt of the piston with oil return apertures 58 being formed through the skirt at the base of the groove in a conventional manner.

Of importance is the fact that the oil scraper ring 56 always remains below the lower side 26B and 29A of the scavenging port and exhaust port opening respectively when the piston is at the top dead center position of its stroke as illustrated in FIG. 1.

The design of the scavenging port opening 26 is such that the lower side 26A inclines inwardly and upwardly towards the wall of the cylinder to provide and create turbulent swirling motion of the scavenging air as it enters in the cylinder in an upward direction for efficient scavenging of the burnst gases, when the scavenging port and exhaust port openings are fully uncovered by the reciprocating piston head passing thereby during the scavenging period.

In operation to this point, reference should be made to FIGS. 1 and 3.

In FIG. 1, within few degrees, before the piston reaches the top dead center of its stroke, a metered amount of an atomized spray of diesel fuel is injected via a conventional fuel injector assembly 22 in the pre-combustion chamber 21 thus initiating ignition of the highly compressed air inside the cylinder between the main combustion chamber 46 of the cylinder head and the crown of the piston domed head. The expanding, burning gases in the main combustion chamber push the piston downward on the power stroke. As the piston continues its power stroke, at approximately 110° to 115° after top dead center, the dome of the piston head starts to uncover the scavenging port 26 and exhaust port 29 openings simultaneously and the scavenging sequence or period commences.

As the piston reaches the bottom dead center of its downward stroke as shown in FIG. 3, both the scavenging port 26 and exhaust port 29 openings are fully uncovered by the dome of the piston head and the full blast of scavenging air supplied by the supercharger 34 enters the cylinder in an upward direction creating a turbulent swirling motion to completely scavenge the burnt but still expanding gases.

When the piston reaches its bottom dead center of its stroke a shown in FIG. 3, half of its scavenging and exhaust period is already accomplished which is approximately 65° of crankshaft rotation.

After the piston passes bottom dead center as shown in FIG. 3, it commences its upward stroke through the opposite 180° portion of the crankshaft rotation and as soon as the dome of the piston head 43 starts to cover the scavenging port and exhaust port openings (which point is approximately 65° of crankshaft rotation from bottom dead center), the scavenging and exhaust period ends and at the same time the compression period begins. As the piston continues its upward travel until it reaches top dead center of its stroke as shown in FIG. 1, one complete cycle of operation is completed and this cycle of operation is repeated again in each cylinder.

It is to be noted that there are four periods of events taking place in one complete 360° cycle of operation, namely one downstroke and one upstroke of the piston. The four periods of events are: power stroke which starts from top dead center and extends to approximately 110° to 115° after top dead center. At this point, the scavenging port 26 and exhaust port openings 29 starts to be uncovered simultaneously so that power, exhaust and scavenging events are taking place simultaneously. Scavenging and re-charging with fresh air extends through approximately 130° to 140° and extends through bottom dead center. As the crankshaft continues its rotation through the opposite 180° rotation after reaching and passing through bottom dead center, the dome of the piston head starts to cover the scavenging port and exhaust port openings simultaneously and the scavenging period ends. As the piston continues its upward stroke towards top dead center, compression takes place unitl the piston approaches the top dead center of its stroke which is approximately 110° to 115° of crankshaft rotation from the end of the scavenging sequence.

It is to be noted further that the scavenging port and exhaust port openings are formed in the same plane in axial position in the lower side of the cylinder which are both uncovered and covered simultaneously by the dome of the piston head passing thereby,. The area of the scavenging port 26 and exhaust port 29 openings are in proportion to the piston displacement of the engine so that one or more scavenging port or exhaust port openings may be provided in the cylinder of such larger engines developing more horsepower.

Another important point to be noted is that when the piston reaches the top dead center position of its stroke as shown in FIG. 1, the aforementioned oil scraper ring 56 always remains below the lower side of the scavenging port 26A and the lower side of the exhaust port 29A openings so that no lubricating oil can escape or discharge through these ports.

In the gas engine shown in FIG. 2, the fuel spray nozzle or fuel injector assembly 24 is of special design that opens under relatively low fuel pressure and is bolted or screwed in into an opening 25 formed into the cylinder adjacent to the upper side of the scavenging port opening so that the duration of the fuel injection period gives the required time for efficient mixing of the metered atomized spray of fuel to the scavenging air.

Reference should be made to the features of the fuel spray nozzle or fuel injector assembly illustrated in detail in FIG. 5. The fuel spray nozzle is preferably formed from alloy steel and is accurately machined. It includes a body 36 having a threaded portion 37 for mounting in the cylinder wall. A further screw threaded portion 38 is provided connecting a low pressure line from a fuel distributor pump (not illustrated).

A calibrated drilled passage 39 extends through the body 36 connecting to a fuel chamber 40 in the opposite end of the body. The cone-shaped design of the needle valve 41 which is held in its matched seat 42, is threaded to the body 36. A cone-shape needle valve 41 is held in position relative to its matched seat by means of a coil spring 43 having a predetermined calibrated tension and spring retainer 44 is mounted at the headed inner end of the cone-shape needle valve to retain the spring in position so that it reacts between the seat and the needle valve normally maintaining the valve upon the seat.

With this design of the fuel spray nozzle, an atomized spray of fuel in metered quantity and supplied by the fuel distributor pump under low fuel pressure, is injected into the cylinder at a precise time when the dome of the piston head position is in a predetermined position relative to the scavenging port opening. The injection of the fuel begins approximately 10° before the dome of the piston head covers the scavenging port opening and ends approximately 5° after the scavenging port opening is covered by the dome of the piston head so that the approximate duration of the fuel injection period is 15° of crankshaft rotation.

Reference should be made to the novel design of the piston assembly illustrated in detail in FIG. 6 and described previously. The piston is preferably formed from aluminum alloy and includes a piston head 42, a piston crown 43 and a surrounding cylindrical skirt portion 44.

The exhaust port 29 is formed within the lower side of the cylinder wall and in the same plane and in axial position to the scavenging port. The port conduit inclines downwardly and outwardly from the wall and is being uncovered and covered simultaneously with the scavenging port 26 by the dome of the piston head 42 passing thereby, the design feature of the said exhaust port is to facilitate the exit of the exhaust gases more freely into the atmosphere.

It is to be noted further that in a gas engine, the design features of the piston assembly as well as the construction of the scavenging port and exhaust port, are all identical to a diesel engine and that the constant pressure feed lubrication system is also utilized.

As discussed previously, starting a cold diesel engine is a major problem especially in countries where extemely cold weather conditions is a major problem. The pre-combustion chamber 21 having a small opening to the main combustion chamber, is installed into a port formed and accurately machined in the cylinder head connecting the main combustion chamber 46, said pre-combustion chamber having a fuel injector 22 and glow plug 23 installed therein. During the starting of the cold engine the said glow plug 23 is first turned on several seconds before the engine is started so that the injected atomized diesel fuel in the pre-combustion chamber ignites readily for ease of starting an extremely cold engine.

As mentioned previously, this invention is suitable for use in detail or gas fueled engine having a single or multi-cylinder, inline or V-type configuration equipped with a supercharger or turbocharger combination and utilizing a constant pressure feed lubrication system as being shown schematically in FIGS. 1, 3 and 4 respectively.

It will also be appreciated that the supercharger 33 can be used with all configurations or alternatively, a turbocharger or supercharger combination connected in series may be utilized as shown schematically in FIGS. 1 and 4 and collectively designated 30.

Figure 7:
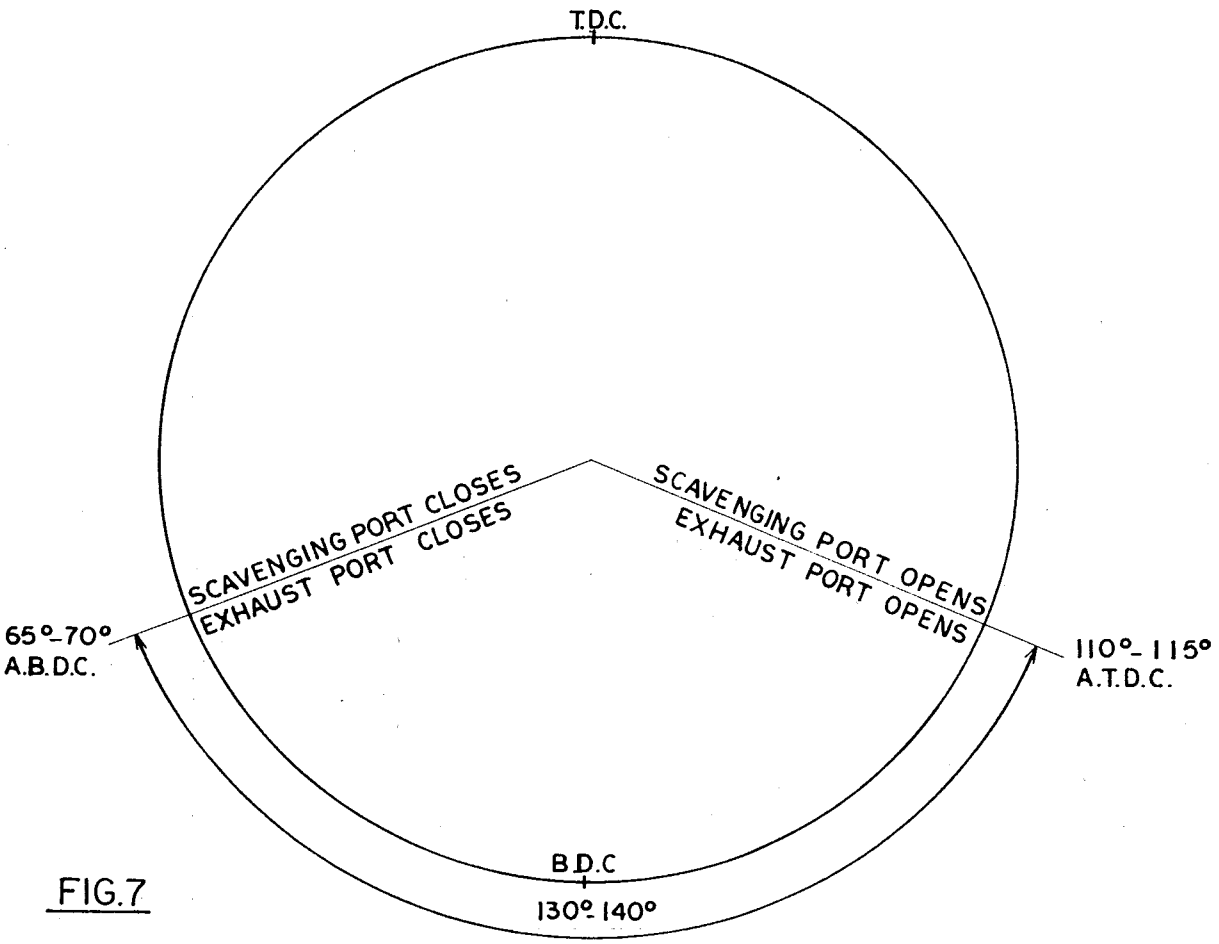
FIG. 7 is an example of the timing diagram for the duration of the opening period of both the scavenging port and exhaust port when both are uncovered simultaneously by the head of the piston.

Reference should be made to FIG. 7 which shows a timing diagram during the scavenging period and the injection period of fuel as applied in a diesel engine equipped with fuel injection equipment. The location of the scavenging port and exhaust port openings formed in the lower side of the cylinder wall determines the duration of the scavenging period which extends approximately 130° to 135° of crankshaft rotation. The scavenging port and exhaust port openings are both uncovered and covered by the dome of the piston head simultaneously.

Figure 8:
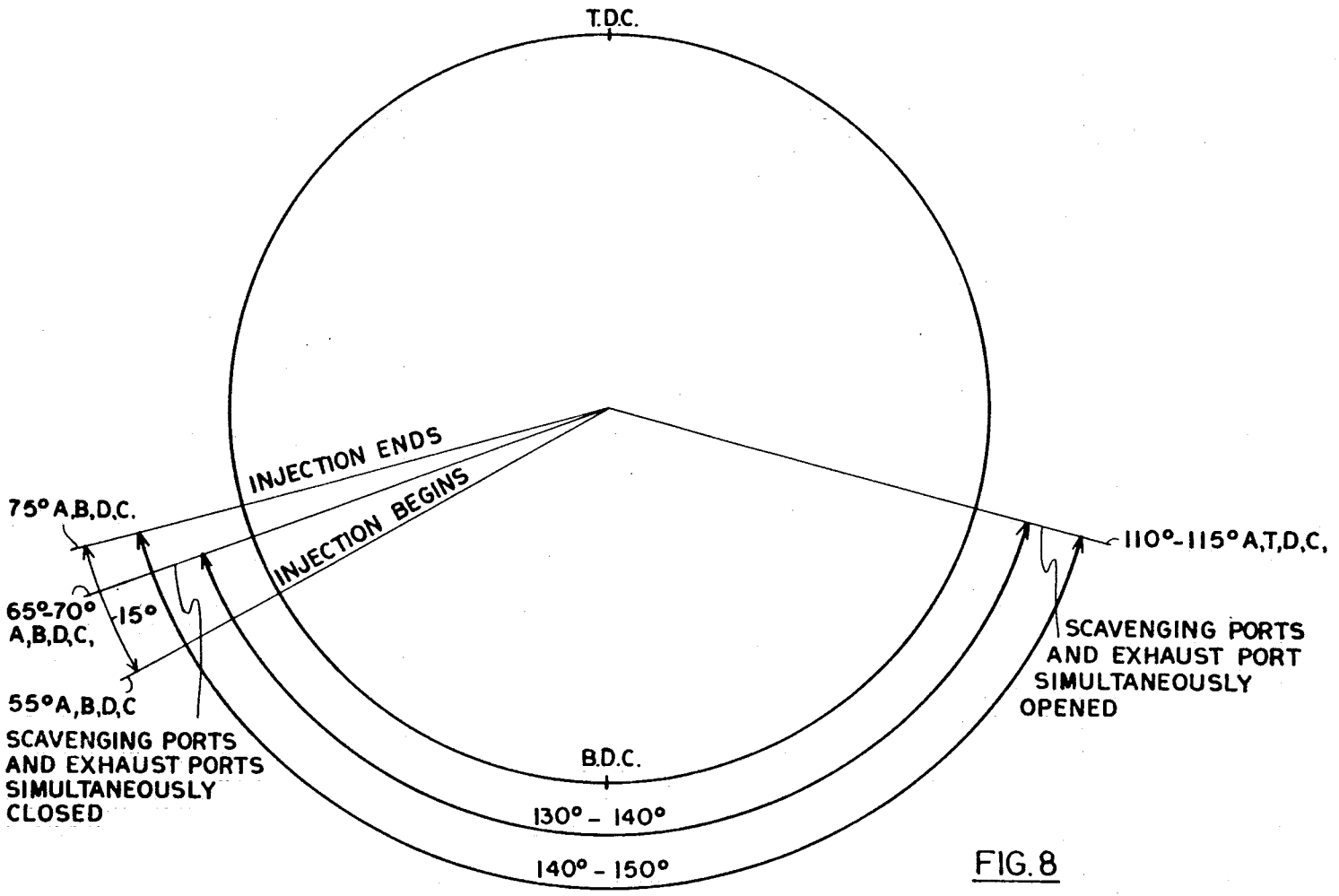
FIG. 8 is an example of timing diagram for a gas engine equipped with fuel injection type of fuel system. It shows the approximate duration of injection period of the spray of the gas fuel and the approximate number of degrees of piston travel in relation to the scavenging port opening when the spray of fuel begins and ends. The duration of the opening period and closing period of both the scavenging port and exhaust port openings which are both uncovered and covered simultaneously by the reciprocating piston are identical for both gas and diesel engine.

Finally, reference should be made to FIG. 8 that shows a timing diagram of the duration of the openings of the scavenging port and exhaust port in relation to the piston degree of travel in a gas engine.

The location of the scavenging port and exhaust port openings formed in the lower side of the cylinder which are uncovered and covered simultaneously by the reciprocating piston that passes therein is shown. The approximate duration of the opening period of the scavenging port and exhaust port is 130° to 140° of crankshaft rotation. The scavenging port and exhaust port openings begin to be uncovered approximately 110° to 115° after top dead center of crankshaft rotation and said port openings are covered approximately 65° to 70° after bottom dead center of crankshaft rotation.

The duration of fuel injection period is approximately 12° to 15° of crankshaft travel in which injection of the gas fuel begins approximately 10° before the scavenging port opening is covered by the dome of the piston head and injection ends approximately 2° to 5° after the scavenging port opening is covered by the dome of the piston head so that complete mixing of the atomized spray of the gas fuel and the scavenging air is achieved.

For the excellent power performance of this invention, the size or the area of the scavenging port and exhaust port openings are both calculated or determined by the piston displacement of such engine and one or more port openings can be utilized to each cylinder of such engines developing relatively large horsepower output. The supercharger or turbocharger combination connected in series as used in this invention, supplies sufficient volume of air required for scavenging the exhaust gases and charging each cylinder during the scavenging period.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A two-stroke supercharged multi-cylinder internal combustion engine, comprising in combination a cylinder block having cylinder bores formed therein, a cylinder head on an upper end of the cylindrical bores defining a main combustion chamber, a piston assembly in each of said cylinder bores and including a piston having a domed head and a connecting rod operatively connected to said piston for reciprocating same between top dead center and bottom dead center, said piston including means to reduce and control the escape of lubricating oil therepast, said means including said piston assembly having a piston skirt extending from said head, a pair of diametrically opposed wrist pin bosses in said skirt below said domed head, a wrist pin mounted within said bosses with a retainer ring installed in an annular groove formed in an outermost edge portion of each of said bosses adjacent outer ends of the wrist pin for restricting endwise movement of said wrist pin, said wrist pin operatively connecting said connecting rod to said piston, sealing "O" rings having high temperature resistance properties installed in an annular groove formed in each of said bosses of the piston adjacent to each end portion of the wrist pin after assembly to prevent the escape and discharge of lubricating oil therepast, at least two compression piston rings situated in spaced and parallel grooves in the head of said piston above said wrist pin bosses and at least one oil scraper ring mounted within an annular groove around the skirt close to a lower edge portion of said skirt, drain holes extending from said groove through said skirt to control and prevent the escape of lubricating oil past individual scavenging port and exhaust port openings, said oil scraper ring always remaining below lowermost edges of said scavenging port and said exhaust port opening when said piston is at top dead center of its stroke, a crankshaft mounted for rotation at a base of the said cylinder block, a re-circulating type constant pressure feed oil pump mounted in the base of said cylinder block and being operatively driven by said crankshaft, an oil pan enclosing the lower side of the cylinder block, said crankshaft and said oil pump, said pump being operatively connected to the lubricating system of said engine, said cylindrical bores having said individual scavenging port and exhaust port openings formed in the lower side of each cylindrical wall in the same plane and axial position, said scavenging port lower side opening inclining inwardly and upwardly towards the walls of the cylinder, said scavenging port and exhaust port openings being both uncovered and covered simultaneously by the reciprocating piston passing thereby.

2. The invention according to claim 1 in which the design of the scavenging port lower side opening being inclined inwardly and upwardly toward the wall of the cylinder, provides a swirling turbulent motion of the scavenging air as it enters inside the cylinder in an upward direction when port opening is fully uncovered, said exhaust port opening being inclined downwardly and outwardly from the lower side of said cylinder wall to facilitate the flow and exit of the exhaust gases to atmosphere.

3. The invention according to claim 1 in which said gas fueled engine includes a fuel injector nozzle bolted or screwed into an opening formed in the lower side of the cylinder close to the upper side of each scavenging port opening, said nozzle metering atomized fuel under low fuel pressure supplied by a fuel distributor pump at a precise timing in relation to piston head crown position at the scavenging port opening, the injection of fuel beginning approximately 10° before the scavenging port opening is covered by the crown of the piston head, and injection of the gas fuel ending approximately 5° after the scavenging port opening is covered of the said piston head crown whereby the duration of the fuel injection period is approximately 15° of crankshaft rotation.

4. The invention according to claim 1 which includes a supercharger being operatively driven by said engine and having an air intake and an air outlet, said outlet being operatively connected to an air manifold bolted to each cylinder to supply air under super-atmospheric pressure to scavenge and charge each of said cylinders.

5. The invention according to claim 1 in which the duration of the closing of said scavenging port and exhaust port is approximately 220° to 230° of crankshaft rotation.

6. The invention according to claim 1 in which the injection of the gas fuel commences approximately 10° before the scavenging port is covered and ends approximately 5° after the scavenging port is covered whereby the duration of the fuel injection period is approximately 15° of crankshaft rotation.

7. The invention according to claim 1 in which said piston uncovers said scavenging port and exhaust port openings simultaneously at approximately 110° to 115° after top dead center, and said scavenging port and exhaust port openings being covered simultaneously by the piston at approximately 65° to 70° after bottom dead center, whereby the duration of the opening period for both the scavenging port and exhaust port is approximately 130° to 140° of crankshaft rotation.

8. The invention according to claim 7 which includes a re-circulating type constant pressure feed lubrication system in which sufficient lubricating oil is stored in the oil pan and being supplied and distributed to all the vital moving parts by means of the pressure feed lubricating pump being operatively driven by the crankshaft by means of gears, said lubrication system using a micronic spin-on oil filter to ensure that clean oil is delivered at all times to the vital and critical moving parts.

9. The invention according to claim 7 which includes a supercharger being operatively driven by said engine and having an air intake and an air outlet, said outlet being operatively connected to an air manifold bolted to each cylinder to supply air under super-atmospheric pressure to scavenge and charge each of said cylinders.

* * * * *